US009948006B2

(12) United States Patent
Chang et al.

(10) Patent No.: US 9,948,006 B2
(45) Date of Patent: Apr. 17, 2018

(54) ANTENNA ASSEMBLY AND ELECTRONIC DEVICE INCLUDING THE SAME

(71) Applicant: Cheng Uei Precision Industry Co., Ltd., New Taipei (TW)

(72) Inventors: Kuo Wei Chang, New Taipei (TW); Wen Bing Hsu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 240 days.

(21) Appl. No.: 14/978,715

(22) Filed: Dec. 22, 2015

(65) Prior Publication Data

US 2017/0179600 A1 Jun. 22, 2017

(51) Int. Cl.
*H01Q 1/24* (2006.01)
*H01Q 9/04* (2006.01)
*H01Q 1/27* (2006.01)

(52) U.S. Cl.
CPC ..... *H01Q 9/0407* (2013.01); *H01Q 1/243* (2013.01); *H01Q 1/273* (2013.01)

(58) Field of Classification Search
CPC ..... H01Q 1/38; H01Q 1/243; H01Q 1/273; H01Q 9/42; H01Q 21/28; H01Q 7/00
See application file for complete search history.

(56) References Cited

U.S. PATENT DOCUMENTS

2014/0266950 A1* 9/2014 Cicero ..... H01Q 1/28 343/789
2014/0285385 A1* 9/2014 Aoki ..... H01Q 1/243 343/702
2014/0361932 A1* 12/2014 Irci ..... H01Q 1/243 343/702
2015/0130666 A1* 5/2015 Pan ..... H02J 7/0045 343/702
2015/0255871 A1* 9/2015 Baringer ..... A61B 5/0002 343/702
2015/0311594 A1* 10/2015 Zhu ..... H01Q 13/10 343/702

* cited by examiner

*Primary Examiner* — Hoang Nguyen
*Assistant Examiner* — Awat Salih
(74) *Attorney, Agent, or Firm* — WPAT, PC

(57) ABSTRACT

An antenna assembly applied in an electronic device with a metal cover, includes a dielectric body, a first radiating element and a second radiating element. The metal cover opens a fastening groove. The dielectric body is fastened in the fastening groove. The first radiating element is mounted to an inner surface of the dielectric body. The first radiating element has a feeding portion. The second radiating element is mounted to an outer surface of the dielectric body and without being electrically connected with the metal cover. The second radiating element is abreast with and adjacent to the first radiating element in an outside-to-inside direction. The first radiating element is coupled with the second radiating element to receive and send electromagnetic wave signals. The electronic device includes the metal cover and the antenna assembly.

16 Claims, 7 Drawing Sheets

| | | | | |
|---|---|---|---|---|
| Antenna Assembly With Metal Cover (First Sample) | Frequency (MHz) | 2402 | 2441 | 2480 |
| | Peak Gain (dBi) | 2.81 | 1.95 | 2.42 |
| | Efficiency (%) | 33.54 | 34.95 | 36.71 |
| | Average Gain (dBi) | -4.74 | -4.57 | -4.35 |
| Antenna Assembly With Metal Cover (Second Sample) | Frequency (MHz) | 2402 | 2441 | 2480 |
| | Peak Gain (dBi) | 2.51 | 3.67 | 3.83 |
| | Efficiency (%) | 36.87 | 44.15 | 43.31 |
| | Average Gain (dBi) | -4.33 | -3.55 | -3.63 |

FIG. 5

| | | | | |
|---|---|---|---|---|
| Antenna Assembly With Plastic Cover | Frequency (MHz) | 2402 | 2441 | 2480 |
| | Peak Gain (dBi) | 1.87 | 2.02 | 1.76 |
| | Efficiency (%) | 30.08 | 29.96 | 26.68 |
| | Average Gain (dBi) | -5.22 | -5.23 | -5.74 |

FIG. 7
(Prior Art)

ANTENNA ASSEMBLY AND ELECTRONIC DEVICE INCLUDING THE SAME

BACKGROUND OF THE INVENTION

1. Field of the Invention

The present invention relates to an antenna, and more particularly to an antenna assembly capable of effectively receiving and sending electromagnetic wave signals, and an electronic device including the antenna assembly.

2. The Related Art

In a prior art, an electronic device generally includes a plastic cover, and an antenna assembly assembled to the plastic cover. Performance indexes of the antenna assembly are listed in a table shown in FIG. 6. When the antenna assembly works at a frequency of 2402 MHz, the peak gain of the antenna assembly is 1.87 dBi, an efficiency of the antenna assembly is 30.08%, and an average gain of the antenna assembly is −5.22 dBi. When the antenna assembly works at a frequency of 2441 MHz, the peak gain of the antenna assembly is 2.02 dBi, the efficiency of the antenna assembly is 29.96%, and the average gain of the antenna assembly is −5.23. When the antenna assembly works at a frequency of 2480 MHz, the peak gain of the antenna assembly is 1.76 dBi, the efficiency of the antenna assembly is 26.68%, and the average gain of the antenna assembly is −5.74 dBi.

Currently, performance requirements of the electronic device are requested higher and higher by a consumer. Not only does a function of the antenna assembly of the electronic device need to be improved, but also a texture of the electronic device needs to be improved. In order to improve the texture of the electronic device, a metal cover is applied in the electronic device.

However, when electromagnetic waves encounter the metal cover, the electromagnetic waves will be reflected by the metal cover that will affect the function of the antenna assembly. As a result, the antenna assembly is unable to effectively receive and send electromagnetic wave signals.

Thus it is essential to provide an innovative antenna assembly and an electronic device, the innovative antenna assembly applied in the electronic device with a metal cover is capable of effectively receiving and sending the electromagnetic wave signals, the electronic device includes the metal cover and the innovative antenna assembly.

SUMMARY OF THE INVENTION

An object of the present invention is to provide an antenna assembly applied in an electronic device with a metal cover. The metal cover opens a fastening groove. The antenna assembly includes a dielectric body, a first radiating element and a second radiating element. The dielectric body is fastened in the fastening groove. The first radiating element is mounted to an inner surface of the dielectric body. The first radiating element has a feeding portion. The second radiating element is mounted to an outer surface of the dielectric body and without being electrically connected with the metal cover. The second radiating element is abreast with and adjacent to the first radiating element in an outside-to-inside direction. The first radiating element is coupled with the second radiating element to receive and send electromagnetic wave signals.

Another object of the present invention is to provide an electronic device. The electronic device includes a metal cover and an antenna assembly. The metal cover opens a fastening groove. The antenna assembly includes a dielectric body fastened in the fastening groove, a first radiating element mounted to an inner surface of the dielectric body, and a second radiating element. The first radiating element has a feeding portion. The second radiating element is mounted to an outer surface of the dielectric body and without being electrically connected with the metal cover. The second radiating element is abreast with and adjacent to the first radiating element in an outside-to-inside direction, the first radiating element is coupled with the second radiating element to receive and send electromagnetic wave signals.

As described above, the dielectric body is fastened in the fastening groove, the first radiating element is mounted to the inner surface of the dielectric body, and the second radiating element is mounted to the outer surface of the dielectric body and without being electrically connected with the metal cover to make the second radiating element abreast with and adjacent to the first radiating element in the outside-to-inside direction, the first radiating element is coupled with the second radiating element, so that a function of the antenna assembly is ensured. As a result, the antenna assembly applied in the electronic device with the metal cover is capable of effectively receiving and sending the electromagnetic wave signals.

BRIEF DESCRIPTION OF THE DRAWINGS

The present invention will be apparent to those skilled in the art by reading the following description, with reference to the attached drawings, in which:

FIG. 5 is a table which lists performance indexes of a first sample and a second sample of the antenna assembly in accordance with the present invention;

FIG. 7 is a table which lists performance indexes of an antenna assembly in a prior art.

DETAILED DESCRIPTION OF THE PREFERRED EMBODIMENT

Figure 1:
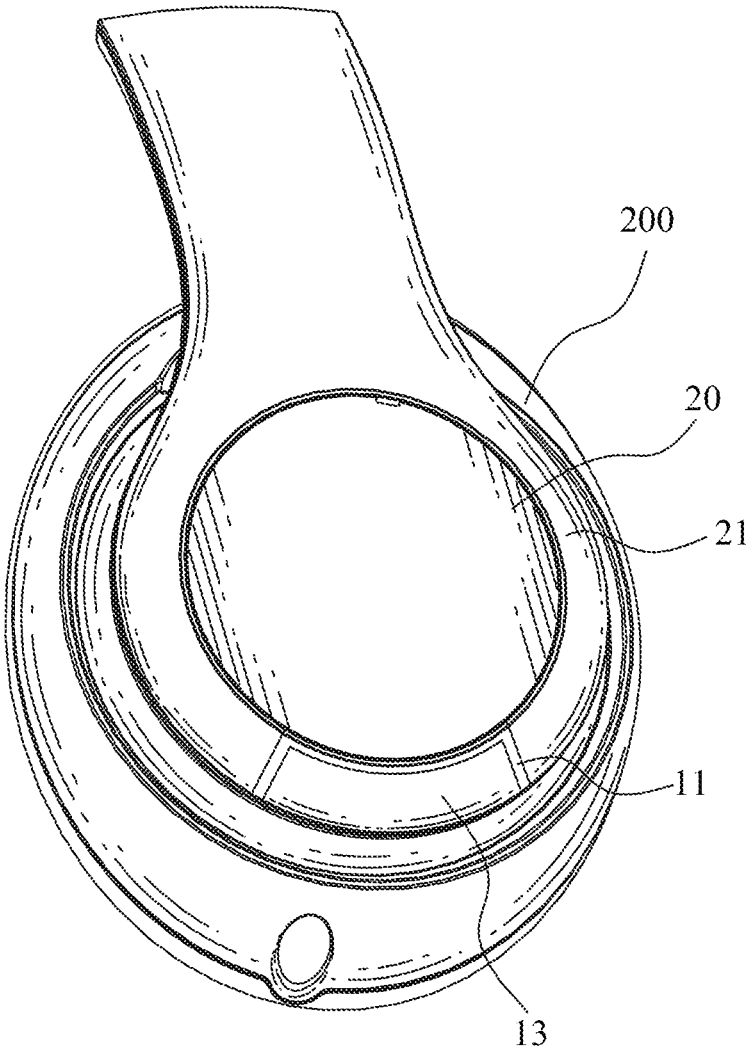
FIG. 1 is a perspective view of an electronic device in accordance with the present invention, wherein an antenna assembly is applied in the electronic device.
Figure 2:
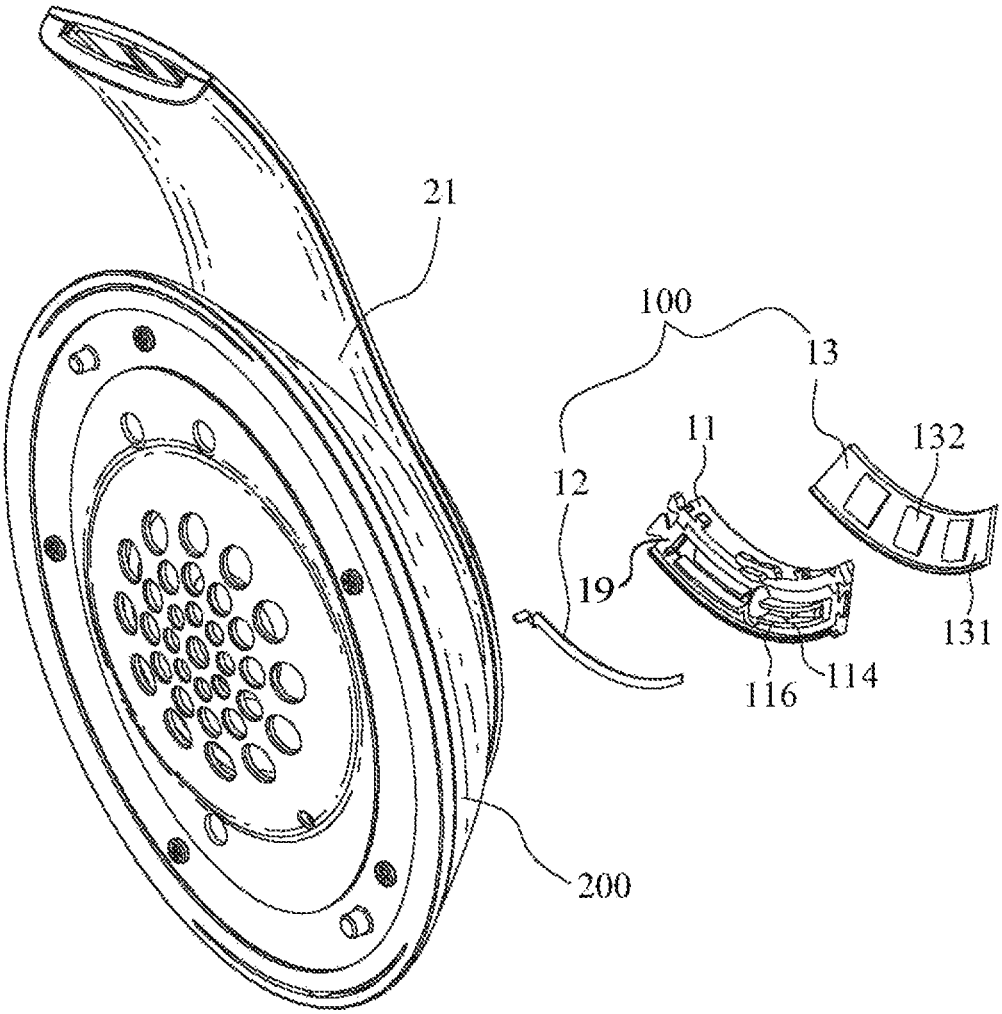
FIG. 2 is a partially exploded view of the electronic device of FIG. 1.
Figure 3:
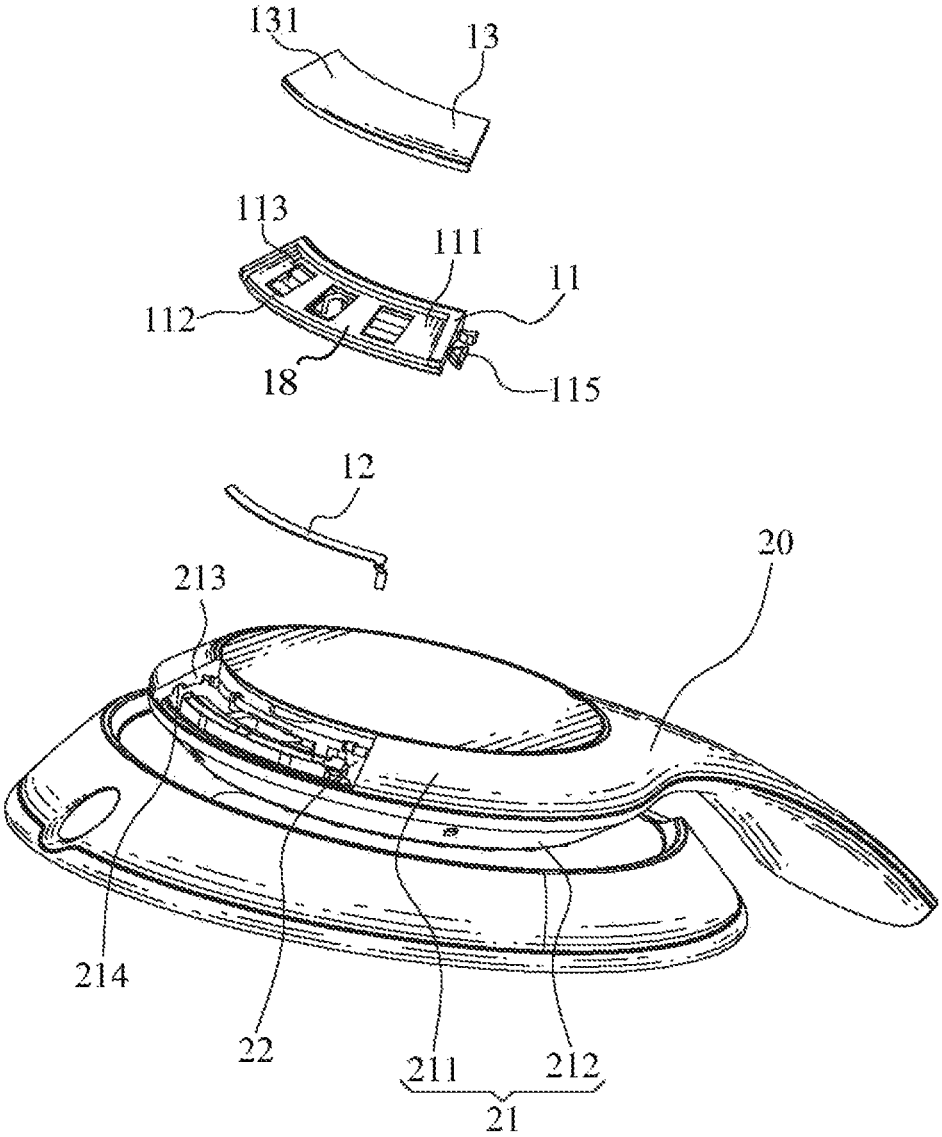
FIG. 3 is another partially exploded view of the electronic device of FIG. 1.
Figure 4:
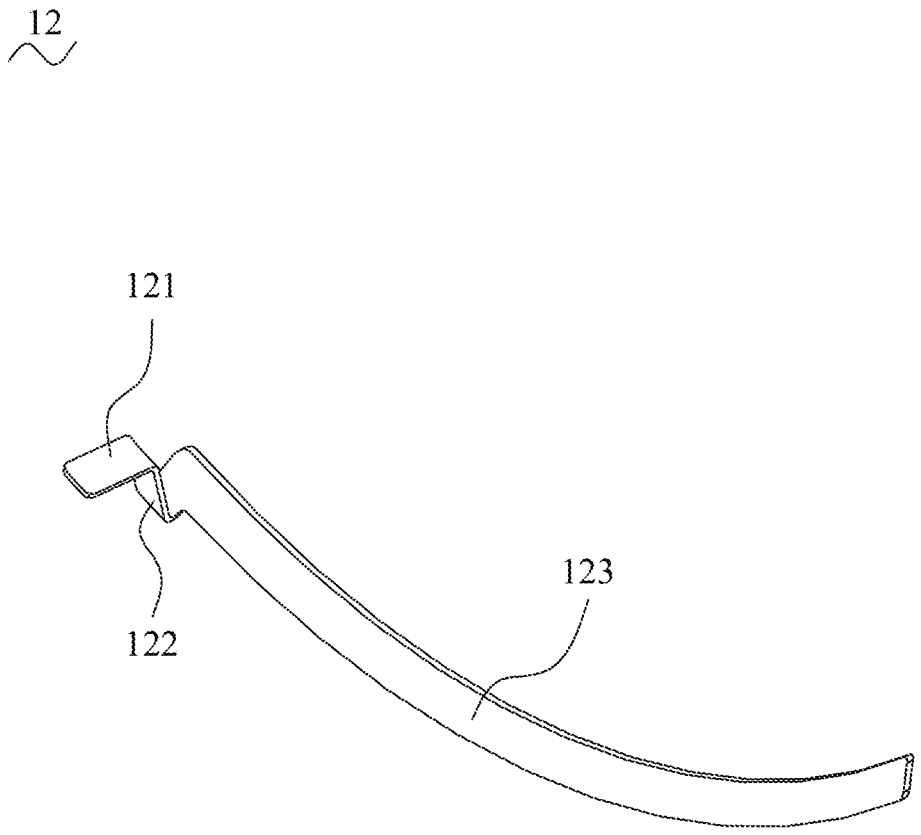
FIG. 4 is a perspective view of a first radiating element of the antenna assembly in accordance with the present invention.
Figure 6:
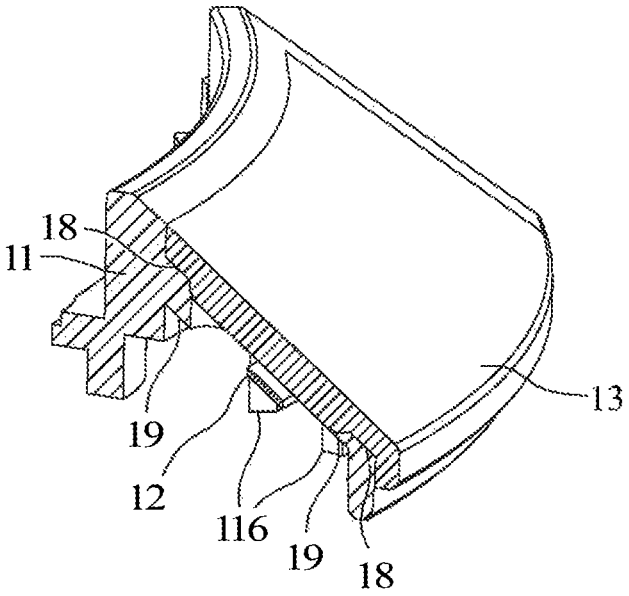
FIG. 6 is a cross-sectional view of the electronic device of FIG. 1, highlighting a portion of the antenna assembly in accordance with the present invention.

Referring to FIG. 1 to FIG. 3, an antenna assembly 100 and an electronic device 200 in accordance with the present invention are shown. The antenna assembly 100 is applied in the electronic device 200 with a metal cover 211 for receiving and sending electromagnetic wave signals. The antenna assembly 100 in accordance with the present invention includes a dielectric body 11, a first radiating element 12 and a second radiating element 13. The electronic device 200 in accordance with the present invention includes a cover 21 and a circuit board (not shown). The circuit board defines an antenna circuit (not shown).

Referring to FIG. 1 to FIG. 3, preferably, the electronic device 200 is a bluetooth headphone. The electronic device 200 includes two main bodies 20 and a head band (not shown) connected between the two main bodies 20. Each of the two main bodies 20 has the metal cover 211 for mounting the antenna assembly 100. An outer surface of the metal cover 211 opens a fastening groove 213. Each side wall of the fastening groove 213 defines at least one fixing groove 214. Specifically, the cover 21 includes the metal cover 211 and a plastic cover 212 matched with the metal cover 211. The metal cover 211 is made of metal. The plastic cover 212 is made of plastic. The metal cover 211 is of a truncated cone shape and at an outside of each of the main bodies 20. The metal cover 211 cooperates with the plastic cover 212 to form a receiving opening 22 between the metal cover 211 and the plastic cover 212. The fastening groove 213 is communicated with the receiving opening 22. A portion of the metal cover 211 is cut off to form the fastening groove 213.

The dielectric body 11 is substantially arc-shaped. The dielectric body 11 is made of plastic. The dielectric body 11 fits the fastening groove 213. The dielectric body 11 is fastened in the fastening groove 213. An outer surface 18 of the dielectric body 11 is recessed inward to form a lacking cavity 111. Specifically, the lacking cavity 111 is substantially arc-shaped. Several portions of an inner wall of the lacking cavity 111 are recessed inward to form a plurality of auxiliary grooves 112. Inner walls of the auxiliary grooves 112 define a plurality of auxiliary holes 113. Several portions of an inner surface 19 of the dielectric body 11 protrude inward to form a plurality of protruding ribs 116. An accommodating slot 114 is surrounded among the protruding ribs 116. The accommodating slot 114 is communicated with the lacking cavity 111 through the auxiliary grooves 112 and the auxiliary holes 113. Each side surface of the dielectric body 11 has at least one fastening block 115. The fastening block 115 is fastened in the corresponding fixing groove 214.

Referring to FIG. 1 to FIG. 4 and FIG. 6, the first radiating element 12 is mounted to the inner surface 19 of the dielectric body 11. The first radiating element 12 is made of metal. The metal of making the first radiating element 12 is preferably chosen as aluminum or copper. The first radiating element 12 has a peripheral extending strip 123 extending substantially along an extending direction of the metal cover 211, a connecting portion 122 extended inward from an end of the peripheral extending strip 123, and a feeding portion 121 extended from a free end of the connecting portion 122. The feeding portion 121 is disposed in the receiving opening 22. A free end of the feeding portion 121 is fastened to the circuit board and electrically connected with the antenna circuit. The peripheral extending strip 123 of the first radiating element 12 is mounted to the inner surface 19 of the dielectric body 11. The peripheral extending strip 123 of the first radiating element 12 is mounted in the accommodating slot 114 of the dielectric body 11.

The second radiating element 13 is made of metal. The metal of making the second radiating element 13 is preferably chosen as aluminum or copper. The second radiating element 13 has a substantially arc-shaped base plate 131. Several portions of an inner surface of the base plate 131 protrude inward to form a plurality of auxiliary portions 132. The second radiating element 13 is mounted to the outer surface 18 of the dielectric body 11. The second radiating element 13 is mounted to the lacking cavity 111 of the dielectric body 11. The second radiating element 13 is abreast with and adjacent to the first radiating element 12 in an outside-to-inside direction. The second radiating element 13 is abreast with and adjacent to the peripheral extending strip 123 of the first radiating element 12. A distance between the second radiating element 13 and the peripheral extending strip 123 of the first radiating element 12 is within 4 mm. Specifically, the base plate 131 of the second radiating element 13 is mounted in the lacking cavity 111 of the dielectric body 11. The auxiliary portions 132 are received in the auxiliary grooves 112. The second radiating element 13 is without being electrically connected with the metal cover 211. An exterior surface of the second radiating element 13 is consistent with an exterior portion of the outer surface 18 of dielectric body 11 and the exterior surface of the metal cover 211. An area of the second radiating element 13 is larger than an area of the peripheral extending strip 123 of the first radiating element 12. The second radiating element 13 shields the first radiating element 12.

The first radiating element 12 is coupled with the second radiating element 13 to receive and send the electromagnetic wave signals. Specifically, a radiating frequency band of the first radiating element 12 and the second radiating element 13 is ranged between 2400 MHz and 2500 MHz. The first radiating element 12 and the second radiating element 13 resonate at the frequency range covering 2400 MHz to 2500 MHz to receive and send the electromagnetic wave signals corresponding to a frequency band ranged between 2400 MHz and 2500 MHz. So that the antenna assembly 100 applied in the electronic device 200 with the metal cover 211 is capable of effectively receiving and sending the electromagnetic wave signals.

Referring to FIG. 1 to FIG. 5, performance indexes of a first sample and a second sample of the antenna assembly 100 in accordance with the present invention are listed in a table shown in FIG. 5. When the first sample of the antenna assembly 100 works at a frequency of 2402 MHz, the peak gain of the first sample of the antenna assembly 100 is 2.81 dBi, an efficiency of the first sample of the antenna assembly 100 is 33.54%, and an average gain of the first sample of the antenna assembly 100 is −4.74 dBi. When the first sample of the antenna assembly 100 works at a frequency of 2441 MHz, the peak gain of the first sample of the antenna assembly 100 is 1.95 dBi, the efficiency of the first sample of the antenna assembly 100 is 34.95%, and the average gain of the first sample of the antenna assembly 100 is −4.57. When the antenna assembly 100 works at a frequency of 2480 MHz, the peak gain of the first sample of the antenna assembly 100 is 2.42 dBi, the efficiency of the first sample of the antenna assembly 100 is 36.71%, and the average gain of the first sample of the antenna assembly 100 is −4.35 dBi. So the first sample of the antenna assembly 100 has a better performance.

When the second sample of the antenna assembly 100 works at a frequency of 2402 MHz, the peak gain of the second sample of the antenna assembly 100 is 2.51 dBi, an efficiency of the second sample of the antenna assembly 100 is 36.87%, and an average gain of the second sample of the antenna assembly 100 is −4.33 dBi. When the second sample of the antenna assembly 100 works at a frequency of 2441 MHz, the peak gain of the second sample of the antenna assembly 100 is 3.67 dBi, the efficiency of the second sample of the antenna assembly 100 is 44.15%, and the average gain of the second sample of the antenna assembly 100 is −3.55. When the antenna assembly 100 works at a frequency of 2480 MHz, the peak gain of the second sample of the antenna assembly 100 is 3.83 dBi, the efficiency of the second sample of the antenna assembly 100 is 43.31%, and the average gain of the second sample of the antenna assembly 100 is −3.63 dBi. So the second sample of the antenna assembly 100 has a better effect.

As described above, the dielectric body 11 is fastened in the fastening groove 213, the first radiating element 12 is mounted to the inner surface of the dielectric body 11, and the second radiating element 13 is mounted to the outer surface of the dielectric body 11 and without being electrically connected with the metal cover 211 to make the second radiating element 13 abreast with and adjacent to the first radiating element 12 in the outside-to-inside direction, the first radiating element 12 is coupled with the second radiating element 13, so that a function of the antenna assembly 100 is ensured. As a result, the antenna assembly 100 applied in the electronic device 200 with the metal cover 211 is capable of effectively receiving and sending the electromagnetic wave signals.

What is claimed is:

1. An antenna assembly applied in an electronic device with a metal cover, the metal cover comprising an opening with a fastening groove, the antenna assembly comprising:

a dielectric body fastened in the fastening groove;

a first radiating element mounted to an inner surface of the dielectric body, the inner surface of the dielectric body facing away from the metal cover, the first radiating element having a feeding portion; and a second radiating element mounted to an outer surface of the dielectric body and without being electrically connected with the metal cover, the outer surface of the dielectric body facing toward the metal cover and contrary to the inner surface, the second radiating element being abreast with and adjacent to the first radiating element in an outside-to-inside direction, the first radiating element being coupled with the second radiating element to receive and send electromagnetic wave signals.

2. The antenna assembly as claimed in claim 1, wherein the first radiating element has a peripheral extending strip extending substantially along an extending direction of the metal cover, a connecting portion extended inward from an end of the peripheral extending strip, and the feeding portion extended from a free end of the connecting portion, the peripheral extending strip is mounted to the inner surface of the dielectric body, the second radiating element is abreast with and adjacent to the peripheral extending strip.

3. The antenna assembly as claimed in claim 2, wherein a distance between the second radiating element and the peripheral extending strip of the first radiating element is within 4 mm.

4. The antenna assembly as claimed in claim 2, wherein an area of the second radiating element is larger than an area of the peripheral extending strip of the first radiating element, the second radiating element shields the first radiating element.

5. The antenna assembly as claimed in claim 2, wherein several portions of the inner surface of the dielectric body protrude inward to form a plurality of protruding ribs, an accommodating slot is surrounded among the protruding ribs, the peripheral extending strip of the first radiating element is mounted in the accommodating slot of the dielectric body.

6. The antenna assembly as claimed in claim 1, wherein the outer surface of the dielectric body is recessed inward to form a lacking cavity, the second radiating element is mounted to the lacking cavity.

7. The antenna assembly as claimed in claim 6, wherein the second radiating element has a substantially arc-shaped base plate, several portions of an inner surface of the base plate protrude inward to form a plurality of auxiliary portions, several portions of an inner wall of the lacking cavity are recessed inward to form a plurality of auxiliary grooves, the base plate of the second radiating element is mounted in the lacking cavity of the dielectric body, the auxiliary portions are received in the auxiliary grooves.

8. The antenna assembly as claimed in claim 7, wherein inner walls of the auxiliary grooves define a plurality of auxiliary holes, several portions of the inner surface of the dielectric body protrude inward to form a plurality of protruding ribs, an accommodating slot is surrounded among the protruding ribs, the accommodating slot is communicated with the lacking cavity through the auxiliary grooves and the auxiliary holes.

9. The antenna assembly as claimed in claim 1, wherein each side wall of the fastening groove of the metal cover defines at least one fixing groove, each side surface of the dielectric body has at least one fastening block, the fastening block is fastened in the corresponding fixing groove.

10. The antenna assembly as claimed in claim 1, wherein a radiating frequency band of the first radiating element and the second radiating element is ranged between 2400 MHz and 2500 MHz.

11. The antenna assembly as claimed in claim 1, wherein an outer surface of the second radiating element is consistent with the outer surface of dielectric body.

12. An electronic device, comprising:

a metal cover comprising an opening with a fastening groove; and an antenna assembly including a dielectric body fastened in the fastening groove;

a first radiating element mounted to an inner surface of the dielectric body, the inner surface of the dielectric body facing away from the metal cover, the first radiating element having a feeding portion; and a second radiating element mounted to an outer surface of the dielectric body and without being electrically connected with the metal cover, the outer surface of the dielectric body facing toward the metal cover and contrary to the inner surface, the second radiating element being abreast with and adjacent to the first radiating element in an outside-to-inside direction, the first radiating element being coupled with the second radiating element to receive and send electromagnetic wave signals.

13. The electronic device as claimed in claim 12, wherein the electronic device is a headphone, the electronic device includes two main bodies, each of the two main bodies has the metal cover for mounting the antenna assembly.

14. The electronic device as claimed in claim 13, wherein the metal cover is of a truncated cone shape and at an outside of each of the main bodies.

15. The electronic device as claimed in claim 14, wherein a portion of the metal cover is cut off to form the fastening groove, the dielectric body fits the fastening groove, the first radiating element has a peripheral extending strip extending substantially along an extending direction of the metal cover, the peripheral extending strip is mounted to the inner surface of the dielectric body, the second radiating element has a substantially arc-shaped base plate.

16. The electronic device as claimed in claim 15, wherein an outer surface of the second radiating element is consistent with the outer surface of dielectric body and an outer surface of the metal cover.

* * * * *